US008757933B2

(12) United States Patent
Li et al.

(10) Patent No.: US 8,757,933 B2
(45) Date of Patent: Jun. 24, 2014

(54) GROUTING CABIN STRUCTURE OF A GROUTED CONNECTION IN A FOUNDATION OF AN OFFSHORE WIND TURBINE GENERATOR

(71) Applicant: Hydrochina Huadong Engineering Corporation, Hangzhou (CN)

(72) Inventors: Wei Li, Hangzhou (CN); Yongming Zheng, Hangzhou (CN); Yong Zhou, Hangzhou (CN); Shengxiao Zhao, Hangzhou (CN); Yingchun Zhuang, Hangzhou (CN); Caiyun Huan, Hangzhou (CN); Na Lv, Hangzhou (CN)

(73) Assignee: Hydrochina Hangzhou Engineering Corp (CN)

( * ) Notice: Subject to any disclaimer, the term of this patent is extended or adjusted under 35 U.S.C. 154(b) by 0 days.

(21) Appl. No.: 13/623,164

(22) Filed: Sep. 20, 2012

(65) Prior Publication Data

US 2013/0259581 A1 Oct. 3, 2013

(30) Foreign Application Priority Data

Jan. 19, 2012 (CN) ..... 2012 1 0015914

(51) Int. Cl.
*E02B 17/00* (2006.01)

(52) U.S. Cl.
USPC ..... 405/227; 405/225

(58) Field of Classification Search
USPC ..... 405/203, 204, 216, 224, 227, 251, 225
See application file for complete search history.

(56) References Cited

U.S. PATENT DOCUMENTS

| | | | | | |
|---|---|---|---|---|---|
| 3,213,629 | A * | 10/1965 | Manning | 405/225 |
| 3,550,384 | A * | 12/1970 | Bardgette et al. | 405/227 |
| 3,878,687 | A * | 4/1975 | Tragesser, Jr. | 405/225 |
| 4,184,790 | A * | 1/1980 | Bassett | 405/225 |
| 4,240,767 | A * | 12/1980 | Gracia | 405/227 |
| 4,273,474 | A * | 6/1981 | Weidler | 405/225 |
| 4,412,759 | A * | 11/1983 | Britton et al. | 405/225 |
| 4,422,805 | A * | 12/1983 | Sweatman | 405/225 |
| 4,902,170 | A * | 2/1990 | Knox et al. | 405/225 |
| 5,028,171 | A * | 7/1991 | Gray | 405/225 |
| 6,536,991 | B1 * | 3/2003 | Trader et al. | 405/216 |
| 7,993,107 | B2 * | 8/2011 | Gevers | 405/227 |
| 8,511,940 | B2 * | 8/2013 | Hall | 405/228 |
| 2009/0123235 | A1 * | 5/2009 | Maconochie et al. | 405/227 |
| 2011/0135400 | A1 * | 6/2011 | Hall | 405/228 |
| 2012/0107053 | A1 * | 5/2012 | Baumfalk | 405/227 |
| 2012/0263545 | A1 * | 10/2012 | Oestergaard et al. | 405/227 |
| 2012/0282037 | A1 * | 11/2012 | Luppi | 405/227 |
| 2013/0202447 | A1 * | 8/2013 | Oestergaard | 416/244 R |

* cited by examiner

*Primary Examiner* — Frederick L Lagman
(74) *Attorney, Agent, or Firm* — Sam Bergstrom

(57) ABSTRACT

A grouting cabin structure of a grouted connection for use in a foundation of an offshore wind turbine generator is described. The structure includes a pile, a sleeve which is coaxial with said pile and installed outside said pile, and a first grouting exhaust port and a first connection port for a grouting pipe provided at an upper part and a lower part of said sleeve. An enclosed cabin of a barrel form is arranged in a gap between said pile and said sleeve, said enclosed cabin is formed by an internal wall of said cabin and said sleeve, a second connection port for the grouting pipe and a second grouting exhaust port are provided at a lower and an upper part of said enclosed cabin, respectively; the cabin and pile form a first grouting space and said cabin and said sleeve forms a second grouting space.

8 Claims, 5 Drawing Sheets

GROUTING CABIN STRUCTURE OF A GROUTED CONNECTION IN A FOUNDATION OF AN OFFSHORE WIND TURBINE GENERATOR

TECHNICAL FIELD

The present disclosure relates to a grouting cabin structure of a grouted connection for use in a foundation of an offshore wind turbine generator. The structure is suitable for use in offshore wind power industry.

BACKGROUND

At present, structures for foundations of offshore wind turbine generators usually employ grouted connections. For example, for a mono-pile foundation, a tower is connected with a pile via a grouted connection; for a tripod foundation and jacket foundation, a jacket is connected with piles via a grouted connection between pile sleeves and piles.

In practical implementation, performance of grouted connections can be improved by enhancing the strength of the grouting material and improving grouting techniques, and structural designs of grouted connections also play an important role. The roughness of pipe walls impacts the friction between the pipe and the grout; shear keys may enhance mechanical bond forces. However, all these stress modes are passive. Therefore, it is desired to enhance the bearing capacity of grouted connections by means of active holding actions of pre-stresses.

SUMMARY

To solve one or more of the above mentioned problems, the present disclosure provides a grouting cabin structure of a grouted connection for use in a foundation of an offshore wind turbine generator (WTG). By arranging an enclosed cabin at a grouted connection section and by means of grouting and pressurized grouting, an active holding force within the grouted connection section can be generated and, as a result, the bearing capacity of the grouted connection section can be enhanced.

The present disclosure provides a grouting cabin structure of a grouted connection for use in a foundation of an offshore wind turbine generator (WTG), the structure comprising a pile (2), a sleeve (1) which is coaxial with said pile (2) and installed outside said pile (2), a first grouting exhaust (5-1) and a first connection port (7-1) for a grouting pipe provided at an upper part and a lower part of said sleeve (1) respectively. An enclosed cabin of a barrel form is provided in a gap between said pile (2) and said sleeve (1) and is concentric and coaxial with them. Said enclosed cabin is formed by an internal wall (3) of said cabin and said sleeve (1). A second connection port (7-2) for a grouting pipe and a second grouting exhaust port (5-2) are provided at a lower part and an upper part of the enclosed cabin, hence close to a side of said sleeve (1). A gap between the internal wall (3) of the said cabin and an external wall of said pile (2) forms a first grouting space (6) and a gap between said internal wall (3) of said cabin and said sleeve (1) forms a second grouting space (4).

The grouting cabin structure may comprise a plurality of said enclosed cabins, which may be arranged in intervals.

In the grouting cabin structure, a thickness of an internal wall (3) of said cabin may be 2 mm~T/5, wherein T refers to a thickness of a wall of said sleeve (1).

In the grouting cabin structure, a first set of one or more shear keys (8) may be arranged on an external wall of said pile (2), and a second set of one or more shear keys (3-1) may be arranged on an internal wall (3) of said cabin at a side facing said pile (2). Said first set of shear keys (8) and said second set of shear keys (3-1) may be arranged in a staggered way.

The grouting cabin structure provided by the present disclosure feature at least the following advantages: By arranging an enclosed cabin in a grouted connection section and by means of grouting and pressurized grouting in said cabin, active holding forces (pre-stresses, including pre-stress due to expansion of grouting materials) can be generated within the grouted connection section between the internal wall of the cabin and the external wall of the pile; as a result, the performance of the grouted connection section can be enhanced.

DETAILED DESCRIPTION OF PREFERRED EMBODIMENTS

Embodiment 1

Figure 1:
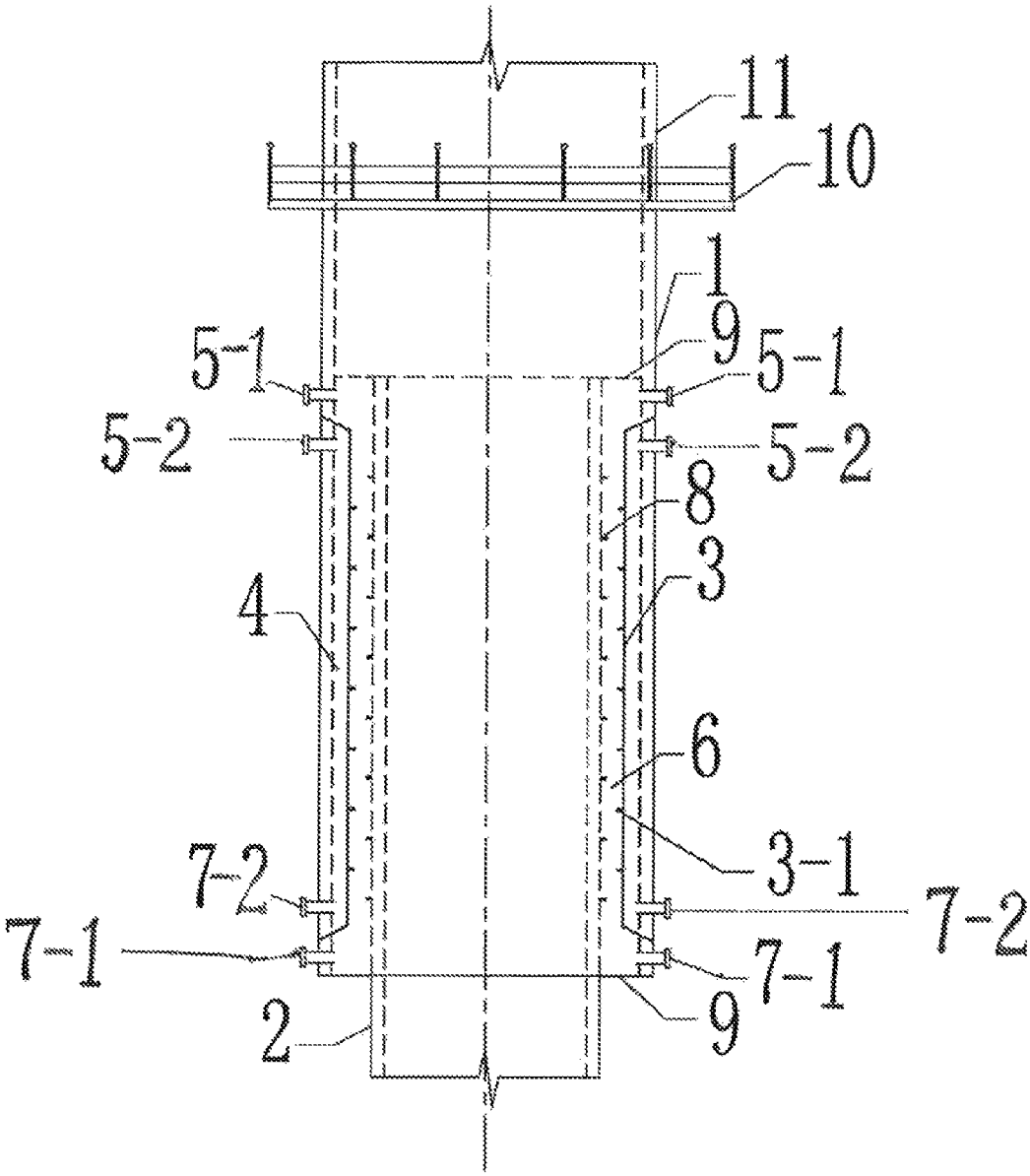
FIG. 1 shows a grouting cabin structure for use in a mono-pile foundation.
Figure 3:
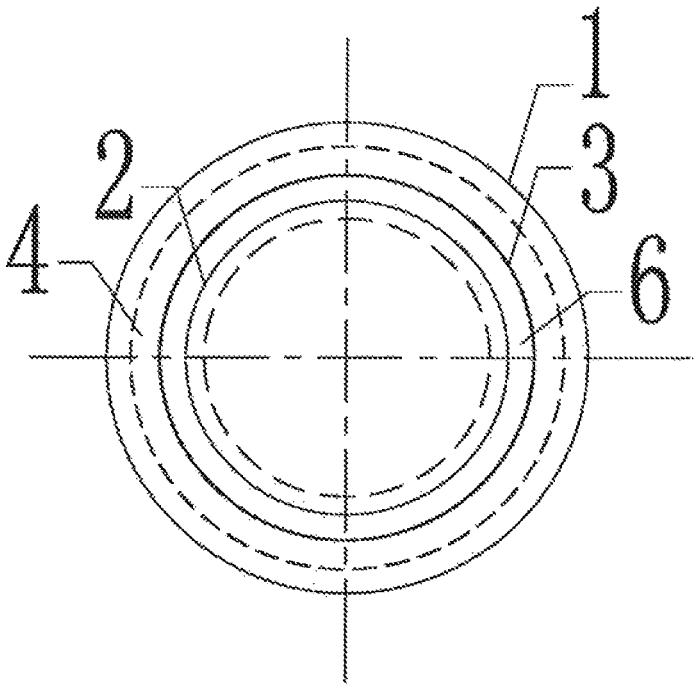
FIG. 3. is a cross-section view of the grouting cabin structure shown in FIG. 1.
Figure 4:
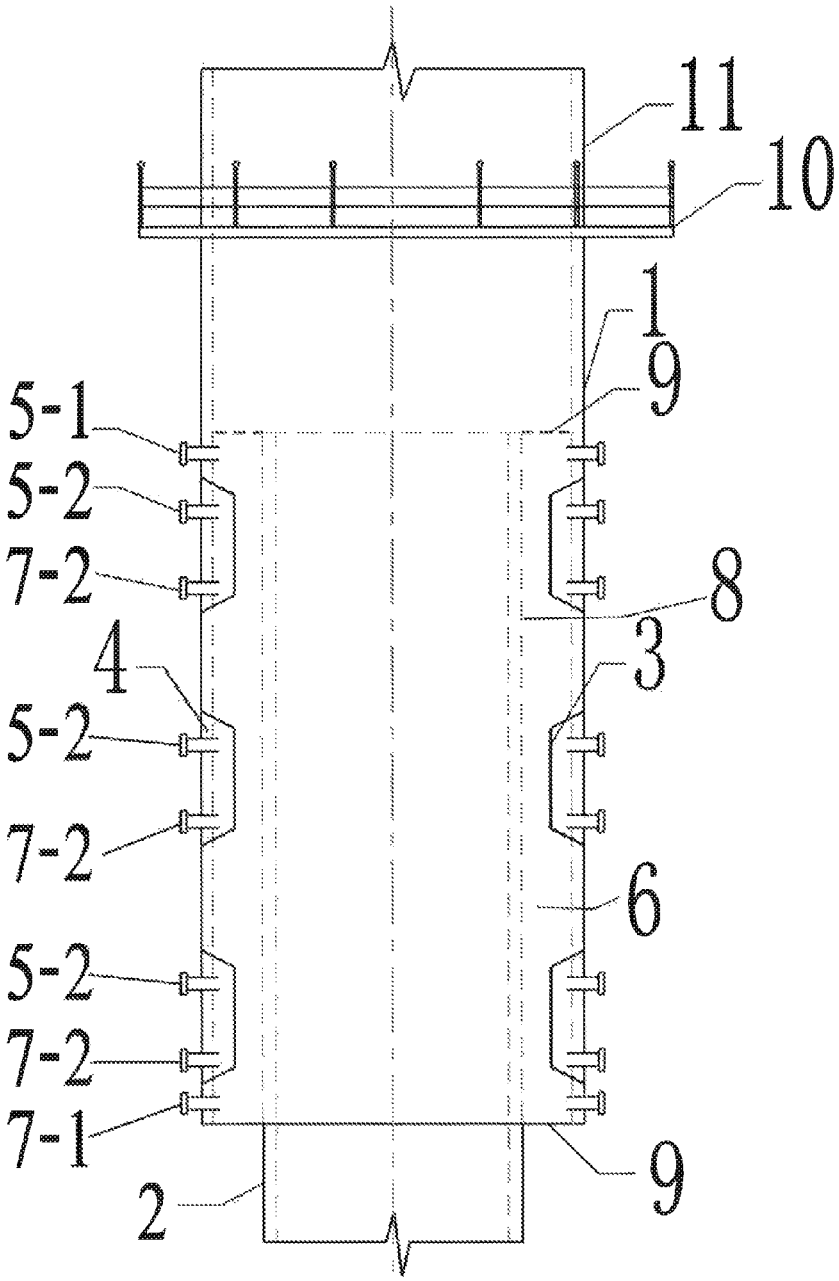
FIG. 4 shows another grouting cabin structure for use in a mono-pile foundation.
Figure 5:
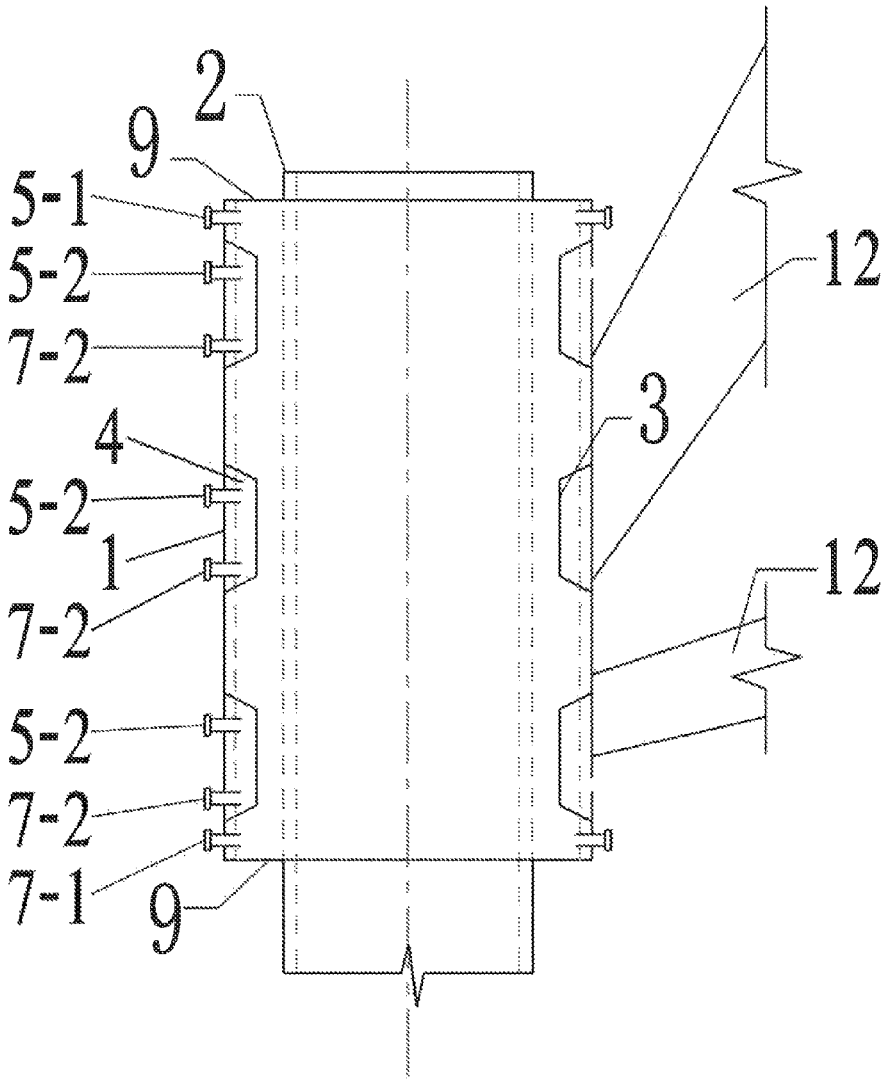
FIG. 5. shows another grouting cabin structure for use in a tripod jacket foundation.

As shown in FIG. 1 and FIG. 3, the grouting cabin structure comprises a pile (2) and a sleeve (1) which is coaxial with said pile (2) and installed outside said pile (2), a grouting exhaust port (5-1) and a connection port (7-1) for a grouting pipe provided at an upper part and a lower part of said sleeve (1), respectively. An enclosed cabin of a barrel form is provided in a gap between said pile (2) and said sleeve (1) and is concentric and coaxial with them; said enclosed cabin is formed by an internal wall (3) of said cabin, said sleeve (1), and an upper and a lower end plates (9). A second connection port (7-2) for a grouting pipe and a second grouting exhaust port (5-2) are provided for said enclosed cabin and are arranged respectively at a lower and an upper parts of the cabin respectively, thus close to a side of said sleeve (1). A gap between said internal wall (3) of said cabin and an external wall of said pile (2) forms a first grouting space (6) and a gap between said internal wall (3) of said cabin and said sleeve (1) forms a second grouting space (4). A first set of one or more shear keys (8) are arranged on an external wall of said pile (2), and a second set of one or more shear keys (3-1) are arranged on said internal wall (3) of said cabin and facing said pile (2). Said first set of shear keys (8) and said second set of shear keys (3-1) arranged in a staggered way. (Said internal wall (3) of said cabin are preferably thick enough so that said second set of shear keys may be arranged.) Said enclosed cabin and said shear keys operate in coordination.

Where necessary, partitioned design may be employed for the enclosed cabin based on optimization calculations. That is to say, a plurality of said enclosed cabins may be provided in intervals, as shown in FIGS. 4 and 5. A thickness of said internal wall (3) of said cabin is 2 mm~T/5, wherein T refers to a thickness of a well of said sleeve (1), and the parameters should be selected based on optimization as required in practical design.

It is advantageous to add expansion agent to grouting materials so as to enhance the effect of pre-stresses due to expansion.

In this embodiment, said sleeve (1) may be connected to a tower (11) of the wind turbine generator via a flange (10).

In this embodiment, a connection between said enclosed cabin and said sleeve (1) may be prefabricated in a factory. After said pile (2) is inserted into said sleeve (1), they are concentric and coaxial with each other.

During construction, the following process may be employed: Firstly, grouting said first grouting space (6) between said internal wall (3) of said cabin and an external wall of said pile (2); then grouting said second grouting space (4) in said cabin; closing the grouting exhaust port when mortar spills out; continuing with grouting to enhance the pressure in said enclosed cabin (by increasing pressure) until the pressure in said enclosed cabin reaches a predefined value. (The expansion effects of grouting materials comprising expansion agents on pre-stresses and the decay of pre-stresses after a still period should be considered. The actual value of the pressure should be determined based on test data or test results.)

When the pressure in said enclosed cabin reaches the predefined value, stop grouting and close said connection port of the grouting pipe. At this time, said enclosed cabin provides an active holding action (viz. pre-stress) to said first grouting space (6) and said pile (2).

Embodiment 2

Figure 2:
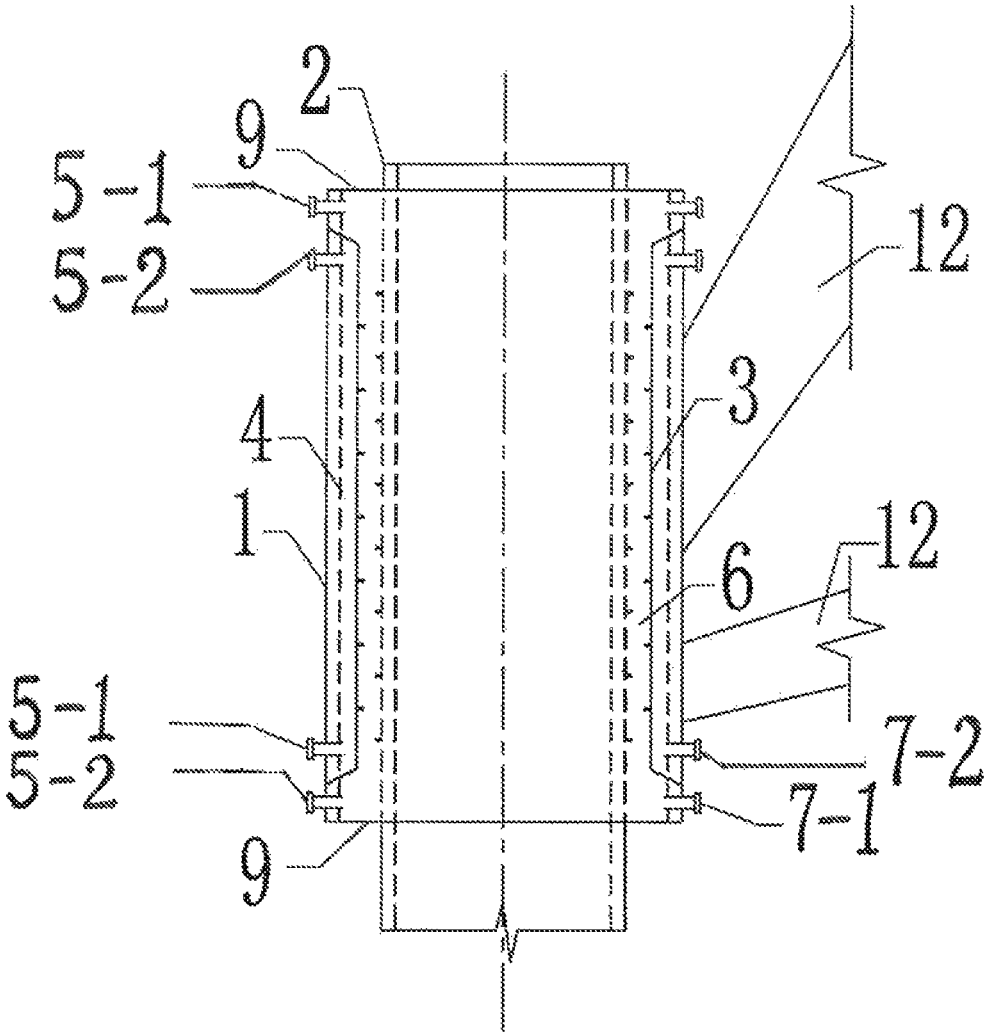
FIG. 2. shows another grouting cabin structure for use in a tripod jacket foundation.

Referring to FIG. 2, a jacket foundation comprises a pile sleeve (1), a support structure (12), a jacket structure (not shown) which is connected to a main column (not shown). Said jacket foundation provides a support for a tower for the wind turbine generator and other components arranged above. This embodiment is also applicable to tripod and multiple-pile jacket foundations. Other components of this embodiment are the same as those of Embodiment 1.

Embodiment 3

FIG. 4 shows a plurality of said enclosed cabins provided in intervals. Other components of this embodiment are the same as those of Embodiment 1.

Embodiment 4

FIG. 5 shows a plurality of said enclosed cabins provided in intervals. Other components of this embodiment are the same as those of Embodiment 1 and Embodiment 2.

The invention claimed is:

1. A grouting cabin structure of a grouted connection for use in a foundation of an offshore wind turbine generator, the structure comprising:

a pile;

a sleeve which is coaxial with said pile and installed outside said pile; and a first grouting exhaust port and a first connection port for a grouting pipe provided at an upper part and a lower part of said sleeve, respectively;

wherein an enclosed cabin of a barrel form is arranged in a gap between said pile and said sleeve and is concentric and coaxial with said pile and said sleeve;

wherein said enclosed cabin is formed by an internal wall of said enclosed cabin and an internal wall of said sleeve;

wherein a second connection port for the grouting pipe and a second grouting exhaust port are provided at a lower and an upper part of said enclosed cabin, respectively; and wherein a gap between said internal wall of said enclosed cabin and an external wall of said pile forms a first grouting space and a gap between said internal wall of said enclosed cabin and said sleeve forms a second grouting space.

2. The structure according to claim 1, wherein the structure comprises a plurality of said enclosed cabins.

3. The structure according to claim 1, wherein a thickness of the internal wall of said enclosed cabin is 2 mm~T/5, wherein T refers to a thickness of a wall of said sleeve.

4. The structure according to claim 2, wherein a thickness of the internal wall of said enclosed cabin is 2 mm~T/5, wherein T refers to a thickness of a wall of said sleeve.

5. The structure according to claim 1, wherein a first set of one or more shear keys are arranged on an external wall of said pile, a second set of one or more shear keys are arranged on the internal wall of said enclosed cabin and facing said pile, wherein said first set of shear keys and said second set of shear keys are arranged in a staggered way.

6. The structure according to claim 2, wherein a first set of one or more shear keys are arranged on an external wall of said pile, a second set of one or more shear keys are arranged on the internal wall of said enclosed cabin and facing said pile, wherein said first set of shear keys and said second set of shear keys are arranged in a staggered way.

7. A method of constructing a grouting cabin structure according to claim 1, the method comprising the steps of:

grouting said first grouting space between said internal wall of said enclosed cabin and said external wall of said pile;

grouting said second grouting space in said enclosed cabin;

closing said first grouting exhaust port when grouting material spills out;

continuing with grouting to enhance pressure in said enclosed cabin until the pressure in said enclosed cabin reaches a predefined value;

stopping grouting when the pressure in said enclosed cabin reaches the predefined value and closing said first connection port of said grouting pipe.

8. The method according to claim 7, further comprising the step of adding expansion agent to the grouting material used for grouting.

* * * * *

UNITED STATES PATENT AND TRADEMARK OFFICE

CERTIFICATE OF CORRECTION

PATENT NO. : 8,757,933 B2
APPLICATION NO. : 13/623164
DATED : June 24, 2014
INVENTOR(S) : Li et al.

It is certified that error appears in the above-identified patent and that said Letters Patent is hereby corrected as shown below:

On the title page item (73) Assignee name should show "Hydrochina Huadong Engineering Corporation"

Signed and Sealed this
Third Day of February, 2015

Michelle K. Lee

Michelle K. Lee
*Deputy Director of the United States Patent and Trademark Office*